United States Patent [19]

Riedel

[11] Patent Number: 4,809,378

[45] Date of Patent: Mar. 7, 1989

[54] DECATIZING METHOD AND APPARATUS

[75] Inventor: Dieter Riedel, Porta Westfalica, Fed. Rep. of Germany

[73] Assignee: Johannes Menschner Maschinenfabrik GmbH & Co, KG, Viersen, Fed. Rep. of Germany

[21] Appl. No.: 203,256

[22] Filed: May 27, 1988

[30] Foreign Application Priority Data

Jul. 11, 1987 [DE] Fed. Rep. of Germany ..... 3723048

[51] Int. Cl.[4] ..... D06B 1/02

[52] U.S. Cl. ..... 8/149.3; 68/5 A; 68/5 B; 68/13 R

[58] Field of Search ..... 68/13 R, 5 D, 5 R, 5 A, 68/5 B; 8/149.1, 149.3

[56] References Cited

U.S. PATENT DOCUMENTS

| | | | |
|---|---|---|---|
| 2,494,807 | 1/1950 | Haeberlin | 68/5 B |
| 2,684,584 | 7/1954 | McLellan | 68/5 B |
| 3,885,262 | 5/1975 | Riedel | 8/149.3 |
| 3,943,735 | 3/1976 | Riedel | 68/5 R |
| 4,030,320 | 6/1977 | Riedel | 68/5 R |
| 4,102,643 | 7/1978 | Riedel | 68/5 R X |

FOREIGN PATENT DOCUMENTS

| | | | |
|---|---|---|---|
| 2727514 | 12/1978 | Fed. Rep. of Germany | 68/5 R |

*Primary Examiner*—Harvey C. Hornsby
*Assistant Examiner*—Frankie L. Stinson
*Attorney, Agent, or Firm*—Penrose L. Albright; Robert A. Miller

[57] ABSTRACT

The initial moisture content of textile material to be decatized and fixed is controlled by a feedback-type regulator circuit which is responsive to measured values of the water content of vapor clouds produced as the material emerges from its passage around a steaming cylinder. The moisture content is preferably controlled by regulating the amount of water applied by a moistening device upstream of the steaming cylinder.

10 Claims, 1 Drawing Sheet

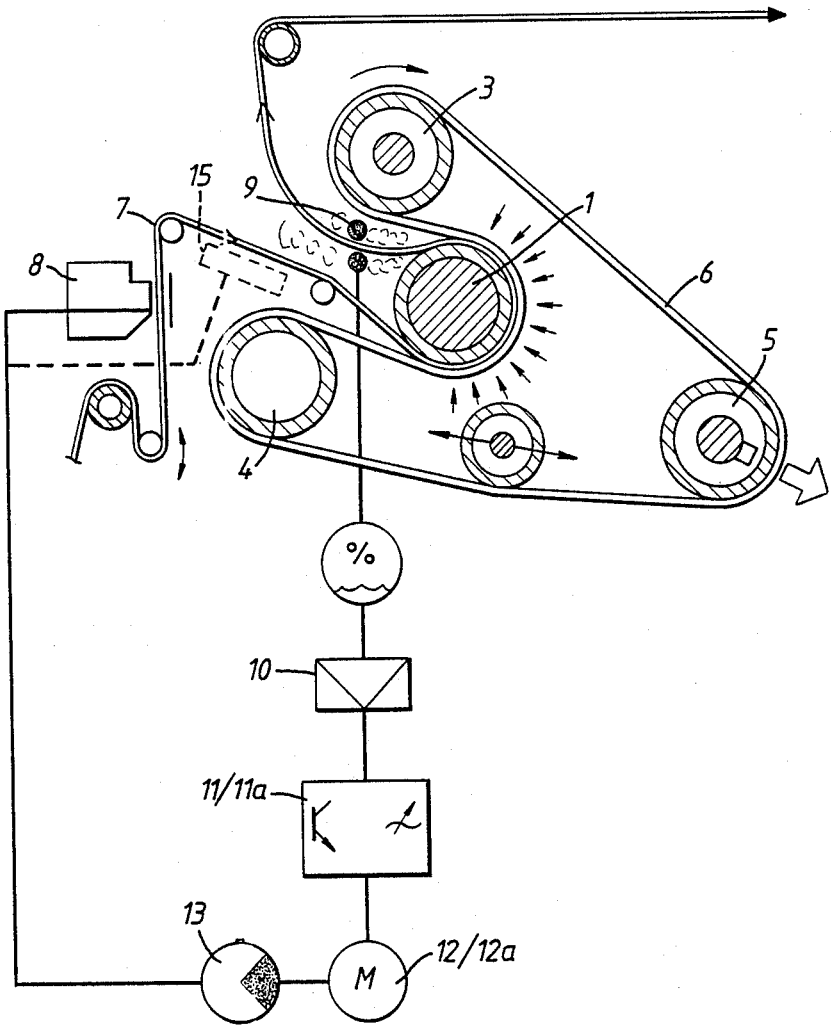
3
15
9
7
1
8
6
5
4
%
10
11/11a
13
M
12/12a

DECATIZING METHOD AND APPARATUS

BACKGROUND OF THE INVENTION

1. Technical Field

The present invention relates to a method for the continuous permanent decatizing and fixing treatment of fabrics, a hosiery and the like. The invention also relates to a device for carrying out such a method.

The present invention is particularly concerned with the type of fabric finishing process in which a textile material is pre-treated with a fixing agent and is then moistened in order to activate the fixing agent immediately before the decatizing and fixing treatment is carried out. The moistening step ensures that the fixing agent is activated and can therefore react fully in the textile material under the physical fixing conditions, such as temperature, duration of treatment and mechanically applied pressure, which may be varied in order to produce the best effect.

2. Prior Art

The use of a moistening device to moisten fabric before it is passed round a heated steaming cylinder of decatizing apparatus is well-known. For example such a moistening stage prior to the decatizing apparatus is described in the applicant's earlier U.S. Pat. No. 4,102,643.

SUMMARY OF THE INVENTION

It has now been appreciated that the amount of moisture which is applied to the textile material has a critical effect on the decatizing and fixing effect achieved. Practice has shown clearly that in the case of too little moisture in the textile material before its entry into the decatizing and fixing zone, only a weak fixing effect is achieved. In the case of too high a moisture content, the maximum fixing effect fails to be achieved because quantitatively more chemicals become activated than can react fully during the following treatment process, which when continuous is of relatively short duration.

The amount of moisture that must be added by the moistening device in order to ensure optimum precipitation of the fixing material also depends upon the kind of fibre of which the textile material is composed, the weight of the material per unit area, the yarn thickness, the pore volume, the initial moisture content, and the absorbency of the textile material as well as the temperature and pressure to be applied during the decatizing and fixing treatment.

It is an object of the invention to provide a method and device which allow the moisture content of the material to be controlled in order to achieve a reproducible decatizing and fixing effect independently of the kind of textile material being processed, its speed, and the temperature of the steaming cylinder and pressure applied during the decatizing treatment.

The method in accordance with the present invention includes the step of continuously measuring the water content of the vapour clouds released from the textile material as it emerges from the steaming cylinder in the decatizing apparatus, and controlling the amount of moisture present in the textile material before it passes around the cylinder in dependence on the measured water content. With this type of feedback control it is possible to ensure that as much water is present in the textile material, which has already been pre-treated with the fixing agent, as will be extracted from the textile material during the decatizing and fixing treatment. In this way it can be ensured that all the activated fixing agent reacts with the material during the steaming process with the consequence that an optimum permanent decatizing and fixing effect is achieved.

The invention also includes an apparatus for carrying out the above defined method, said apparatus including means defining a feed path for a textile material which has been pre-treated with a fixing agent and which is to be subjected to a decatizing and fixing treatment,

- a moistening or drying device positioned in said feed path,
- a pump for supplying water to said moistening device, or for controlling the drying effect of the drying device, a drive motor connected to said pump so as to control the amount of moisture in the textile material, said motor having a control input,
- a rotatably supported steaming cylinder included in said feed path downstream of said moistening or drying device, a plurality of guide rollers,
- a heatable, gas-impermeable pressure belt led over said guide rollers and around said steaming cylinder, said feed path being defined between said steaming cylinder and said pressure belt,
- a moisture sensor positioned adjacent said feed path downstream of said steaming cylinder in order to measure the water content of vapour clouds released from the textile material, said sensor having an output connected to the control input of said driving motor in order to define a regulator circuit.

In a preferred embodiment the regulator circuit between the output of said sensor and the control input of said motor includes a measurement converter and amplifier.

With the method in accordace with the invention, the measured values provide a direct intervention on the quantity of water supplied by the moistening device. The water is fed to the textile material before the decatizing and fixing treatment is, in the region of the decatizing and fixing zone, first of all brought to a temperature above its evaporation temperature. Since the textile material in this zone is being pressed against the steaming cylinder by means of the gas-impermeable pressure belt at a very high applied pressure which improves the transfer of heat, no vapour can escape within this treatment zone. The vapour only becomes free as soon as the textile material emerges from the treatment zone. In practice it is found that the measured values of the moisture in the vapour clouds (percentage water content in the vapour) clearly reveal at what value the optimum fixing effect is achieved. This value once determined remains the desired value and as soon as deviations are measured a corresponding readjustment is effected via the regulator circuit to restore the measured value to the desired value. The amount of moisture applied can be controlled for example by an adjustment of the r.p.m. of the delivery pump acting upon the moistening device. Moreover the regulation of the amount of applied water could also be replaced by a pressure regulation in the pump.

The method in accordance with the invention has the great advantage that the amount of water to be fed to the textile material follows from constantly taking into consideration the following actuating variables: kind of fibre, weight per unit area, yarn thickness, pore volume, initial moisture, absorbency, running speed, treatment temperature and pressure applied during the fixing. All this is achieved by a single continuous measurement of water content in the vapour clouds.

If, for example, the measured moisture in the vapour clouds exceeds the desired value, the amount of water fed to the textile material must be throttled. If on the contrary a reduction in the water content of the vapour is measured, the amount of water is increased via the regulator circuit. A regulation is thereby achieved which is independent of the textile material and its speed.

In the regulator circuit sensors of various different kinds may be employed. Thus, for example, a zirconia moisture analyzer having a zirconia-oxygen element may be employed. The sensor may be used directly in the measuring atmosphere, that is, in the present case in the vapour clouds, where the most exact measured values are to be recorded. The analyzer has a digital indicator upon which the content of water vapour expressed as a percentage by volume is indicated continuously. The quick response, outstanding stability and maintenance-free operation of this type of sensor facilitate the regulating process. The zirconia element consists of zirconium ceramic which at high temperatures behaves with respect to oxygen ions like a solid electrolyte. If on the inside and outside of the zirconium ceramic tube heated platinum electrodes are mounted, the difference between the partial pressure of the oxygen on the inside and outside of the tube brings about an electron flow through the electrolyte. Therefore a voltage is developed between the two electrodes. If the vapour, the water content of which is to be measured, sweeps over one electrode (the reference electrode) and air over the other electrode, a voltage corresponding to the water content develops across the electrodes. This voltage is available as the measured value for use via a measurement converter in the regulator circuit.

In an alternative embodiment the sensor may be a lithium chloride moisture sensor. Through its special construction this type of sensor provides a moisture measurement according to the dewpoint method of measurement, that is, independently of the air pressure and of the air temperature and within a wide range of water content levels.

The measuring principle of the lithium chloride moisture sensor relies on the heating up of a measuring element in a hygroscopic lithium chloride solution until the moisture exchange between the lithium chloride solution and the vapour flowing around the measuring element is equal in both directions. The temperature of the lithium chloride solution at which this state of equilibrium occurs is a direct measure of the absolute water content of the vapour.

Further moisture sensors utilising the laser beam principle may also be used. A focussed laser beam penetrates the vapour atmosphere transversely to the direction of movement of the vapour clouds and depending upon the resistance of the water particles reproduces a corresponding value at a receiver. The impulses obtained from the receiver may after appropriate amplification and conversion be used in the regulator circuit.

A decatizing and fixing apparatus employing the method in accordance with the invention will now be described, by way of example only, with reference to the accompanying drawing.

BRIEF DESCRIPTION OF THE DRAWING

The drawing shows in a purely diagrammatic way an elevation of a decatizing and fixing apparatus.

DESCRIPTION OF A PREFERRED EMBODIMENT

Reference numeral 1 designates a heatable, rotatably mounted steaming cylinder. Reference numerals 3–5 indicate guide rollers around which is led a gas-impermeable endless pressure belt 6. In the part surrounding the steaming cylinder 1 this processure belt 6 lies directly against a web of textile material 7 which is to be decatized and fixed.

A feed path followed by the web of textile material 7 is indicated in the drawing and the feed direction is shown by arrows.

The guide roller 4 is heated so that the pressure belt can be heated independently of the steaming cylinder 1. The guide roller 5 may be tightened steplessly so that maximum clamping forces (about 6.0 kg/cm$^2$) are generated upon the textile material 7 during the decatizing and fixing treatment. Before the textile material 7 enters the decatizing and fixing zone around the steaming cylinder 1 it is first of all moistened by means of a moistening device 8. This moistening device 8 is arranged upstream of the steaming cylinder 1 so that the amount of water applied may enter in the form of very small droplets without loss into the decatizing and fixing zone. For the achievement of optimum moistening rotary spray devices are advantageously employed. Such devices apply water to the textile material 7 in the form of a line-thin spray fan.

A moisture sensor 9 analyzes the water content of the vapour clouds released from the decatized and fixed textile material 7. This sensor 9—looking in the direction of run of the textile material 7—lies directly behind the decatizing and fixing zone.

The sensor 9 may be a zirconium ceramic element, a lithium chloride moisture sensor or a laser beam as previously described.

The measured values from the sensor 9 which correspond to the percentage water content of the vapour are fed into a feedback-type regulator circuit including a measurement converter and amplifier 10. The measured values are then passed either via a rectifier 11 into a control input of d.c. motor 12 or via a frequency converter **11*a* into a control input of a three-phase motor 12*a*. The motor 12 or 12*a* controls the r.p.m. of a delivery pump 13 associated with moistening device 8. A control on the amount of water fed to the textile material 7** is thereby provided.

Instead of regulation of the r.p.m. of the pump 13 the required control of the amount of water applied may also be effected via pressure regulation in the pump 13, though practice shows more exact results are obtained by regulation of the r.p.m. of the delivery pump 13.

It is also conceivable that instead of controlling the amount of moisture applied to the textile material 7, a suction device 15 may be arranged before the steaming cylinder 1, in order to dry relatively wet textile material 7 to a controlled residual moisture. In this case the measured values determined by the sensor 9 are employed in the previously described way after conversion and amplification for regulation of the r.p.m. of the pump 13 which is now acting as a vacuum pump for the suction device. In such a case the degree of vacuum in the region of the suction device influences the initial moisture content of the textile material 7.

I claim:

1. A method for carrying out a continuous permanent decatizing and fixing treatment on a textile material which has been pre-treated with a fixing agent, the method including the steps of moistening the textile material in order to activate the fixing agent, passing the material around at least one rotatably supported steaming cylinder under a heatable gas-impermeable pressure belt which exerts compressive forces on the textile material as it passes around the cylinder, continuously measuring the water content of vapour clouds released from the textile material as it emerges from the steaming cylinder, and controlling the amount of moisture present in the textile material before it passes around the steaming cylinder in dependence on the measured water content.

2. A method according to claim 1, in which the measured water content values are fed via a regulator circuit which controls a device for carrying out the moistening step in order to apply as much water to the pre-treated textile material as will be extracted during the decatizing and fixing treatment.

3. An apparatus is for carrying out a method according to claim 1 or 2, said apparatus including means defining a feed path for a textile material which has been pre-treated with a fixing agent and which is to be subjected to a decatizing and fixing treatment, a moistening or drying device positioned in said feed path, a pump for supplying water to said moistening device, or for controlling the drying effect of the drying device, a drive motor connected to said pump so as to control the amount of moisture in the textile material, said motor having a control input, a rotatably supported steaming cylinder included in said feed path downstream of said moistening or drying device, a plurality of guide rollers, a heatable, gas-impermeable pressure belt led over said guide rollers and around said steaming cylinder, said feed path being defined between said steaming cylinder and said pressure belt, a moisture sensor positioned adjacent said feed path downstream of said steaming cylinder in order to measure the water content of vapour clouds released from the textile material, said sensor having an output connected to the control input of said driving motor in order to define a regulator circuit.

4. Apparatus according to claim 3, in which the regulator circuit between the output of said sensor and the control input of said drive motor includes a measurement converter and amplifier.

5. Apparatus according to claim 4, in which said drive motor is a d.c. motor, and a rectifier is connected in said regulator circuit between said measurement converter and amplifier and said control input of said d.c. motor.

6. Apparatus according to claim 4, in which said drive motor is a three-phase motor, and a frequency converter is connected in said regulator circuit between said measurement converter and amplifier and said control input of said three-phase motor.

7. Apparatus according to claim 3, in which said moisture sensor is selected from:

a zirconia moisture analyzer, a lithium chloride moisture sensor, and a laser beam moisture sensor.

8. Apparatus according to claim 3, in which the moistening or drying device is a moistening device and said pump acts as a delivery pump for controlling the amount of water applied to the textile material by the moistening device.

9. Apparatus according to claim 8, in which the regulator circuit controls the r.p.m. of said delivery pump.

10. Apparatus according to claim 3, in which the moistening or drying device is a suction drying device and said pump is a vacuum pump controlling the degree of drying suction applied to the textile material.

* * * * *